United States Patent [19]

Sawyer, Jr. et al.

[11] Patent Number: 4,714,523

[45] Date of Patent: Dec. 22, 1987

[54] SUCTION ROLL SEAL STRIPS WITH TEFLON INSERT

[76] Inventors: William D. Sawyer, Jr.; William D. Sawyer, Sr., both of 100 Enterprise St., West Monroe, La. 71291

[21] Appl. No.: 943,043

[22] Filed: Dec. 18, 1986

[51] Int. Cl.[4] ..... D21F 3/10

[52] U.S. Cl. ..... 162/371; 162/369; 162/374

[58] Field of Search ..... 162/371, 374, 369

[56] References Cited

U.S. PATENT DOCUMENTS 2,578,551 3/1948 Hornbostel ..... 162/371

*Primary Examiner*—Peter Chin
*Assistant Examiner*—Thi Dang
*Attorney, Agent, or Firm*—Fleit, Jacobson, Cohn & Price

[57] ABSTRACT

Sealing strips mounted on an internal vacuum box and engaged with the internal surface of a perforated rotatable shell forming a suction roll in a conventional paper making machine are contructed from a body portion of organic material having an outer surface forming an interface with an inner surface of the shell, and a PTFE inlay strip exposed at the outer surface of the sealing strip for rubbing against the interior surface of the shell and smearing across the outer surface of the sealing strip to reduce friction and improve lubrication at the interface.

4 Claims, 4 Drawing Figures

SUCTION ROLL SEAL STRIPS WITH TEFLON INSERT

BACKGROUND OF THE INVENTION

This invention relates generally to seal strips for a suction roll in a paper making machine in which the seal strips are uniquely constructed at least so far as an outer edge portion of the strip is concerned which engages an internal surface of a rotating perforated shell of the suction roll, the construction of the strips providing long wear characteristics by reducing friction and improving lubrication between the seal strips and the perforated shell.

In the art of paper making, various machines have been provided for forming paper webs from a pulp slurry with one such machine and method known in the art being the Fourdrinier machine. Such paper making machines include a suction roll underlying a screen belt or the like which includes a perforated cylindrical shell that is rotatably supported together with a stationary vacuum box disposed internally of the perforated shell and connected with a source of vacuum. The vacuum box includes a slotlike structure along one side thereof and seal strips along each side of the slot for engagement with the internal surface of the rotating shell in order to provide a sealing engagement between the vacuum box and the internal surface of the perforated shell so that the vacuum induced on the vacuum box is in communication with the internal surface of the perforated shell to remove water which may penetrate the shell. This structure is well known and typical of such structures is U.S. Pat. No. 2,578,551 issued Dec. 11, 1951. Many other examples of suction roll structures are illustrated in the prior patents classified in Class 162, subclass 371 and the patents in this subclass are incorporated herein by reference thereto. Typical of such structures is the provision of slots or grooves along the outer edges of the slotlike structure formed in the vacuum box with the slots or grooves receiving the seal strips for movement toward and away from the perforated shell. A tube is disposed between the inner edge of the seal strip and the bottom of the slot or groove which can be pneumatically or hydraulically expanded to move the seal strips into sealing engagement with the interior surface of the rotatable perforated shell. Due to the frictional contact between the seal strips and the shell, wear occurs on both the seal strips and shell with the seal strips having a reduced life expectancy and requiring replacement at periodic intervals. In view of the necessity to shut the paper making machine down while the seal strips are being replaced, the life expectancy of the seal strips is important. Also, it is important for the seal strips to maintain dimensional stability and have a reduced coefficient of friction with the perforated shell and not cause environmental pollution during normal use.

SUMMARY OF THE INVENTION

An object of the present invention is to provide a novel seal strip structure for use in the suction roll of a paper making machine and more particularly to a seal strip which is constructed to reduce friction between the outer edge of the seal strip and the inner surface of the rotating perforated shell of the paper making machine thereby, inter alia, reducing the amperage draw on the drive motor which rotates the suction roll, and reducing heat build up and thermal expansion.

It is also an object of the invention to provide a seal strip structure which provides faster wear-in of a new seal strip allowing a paper maker to produce quality paper more quickly on start up of the machine.

A further object of the invention is to provide seal strips mounted on the stationary internal vacuum box oriented within a rotatable perforated shell in a suction roll of a paper making machine which is simple in construction, will fit various types of paper making machines, which is easy to install, durable and long lasting and safe in operation by being constructed of organic materials devoid of asbestos.

A seal strip structure in accordance with the invention which is adapted to meet the above and other objects includes a wear resistant body portion having an outer surface adapted for contact with the interior surface of a rotating shell of a suction roll for a paper making machine, and wherein the body portion has at least one lengthwise extending laid-in strip of polytetrafluoroethylene (Teflon) which is exposed on said outer surface to provide rubbing contact with the interior surface of the rotating shell.

PTFE itself has poor wear resistance, but has the property of transferring or smearing onto a rubbing surface. Accordingly, when used in strip form in a wear resistant seal strip base material, it smears across the outer surface of the seal strip thereby providing improved lubrication between the seal strip and shell. Thus, the PTFE strip may be set into the base material adjacent a leading edge thereof more effectively to smear across the width of the seal strip. The invention may be used in relatively narrow width regular seal strips or in wider so-called silencer strips. In the latter case, the silencer strip may have a pair of laid-in PTFE strips adjacent its opposite edges.

The base material for the seal strips may comprise an organic plastic material, for example, it may have a resin polymer matrix with aramid fiber reinforcement, and with powdered graphite possibly included in the resin to further reduce friction.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
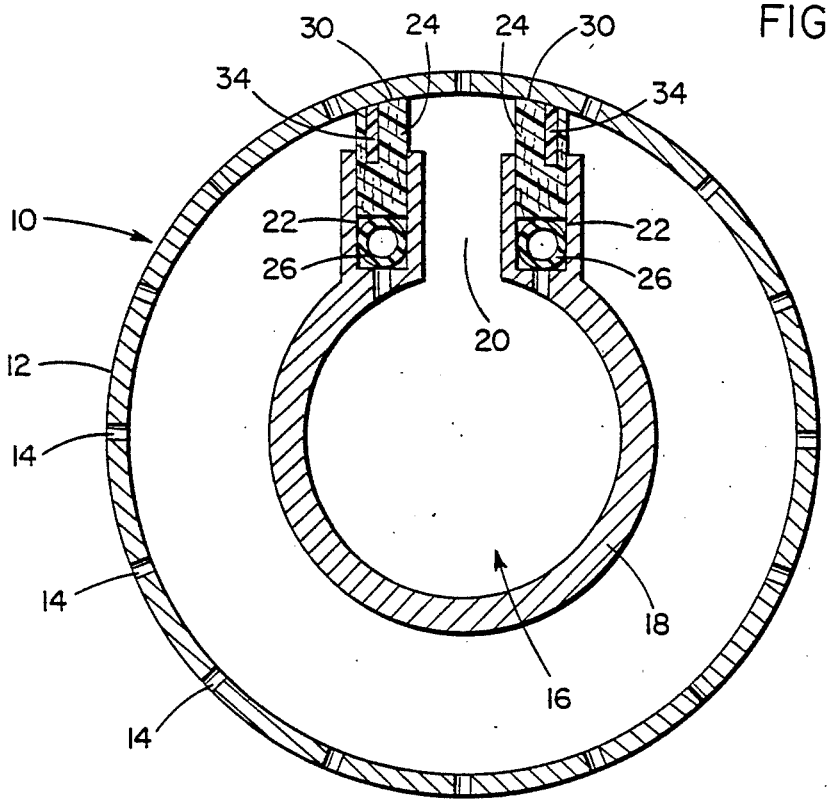
FIG. 1 is a schematic sectional view illustrating the association of a seal strip of the present invention with one edge of a slot-like structure formed in the vacuum box internally of a perforated shell of a suction roll assembly in a paper making machine.
Figure 2:
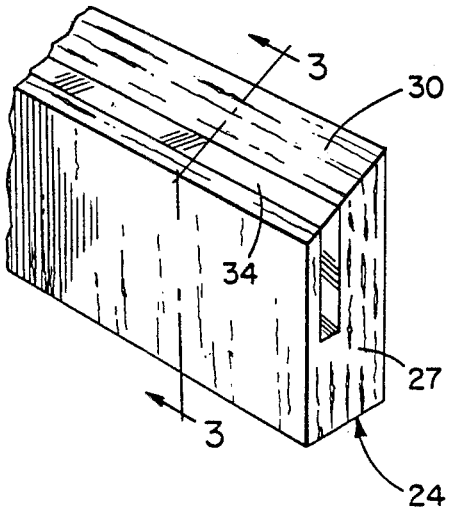
FIG. 2 is an enlarged perspective view of a part of the sealing strip.
Figure 3:
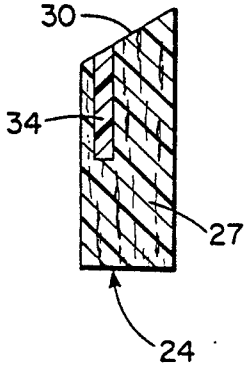
FIG. 3 is a sectional view on line 3—3 of FIG. 2.

Referring now specifically to the drawings, the suction roll of a paper making machine is generally designated by reference numeral 10 and is of conventional construction insofar as a general arrangement of components is concerned. The suction roll 10 includes a rotatable perforated shell 12 of cylindrical configuration with perforations 14 extending therethrough with the shell being constructed of conventional materials used for this purpose such as bronze, stainless steel and the like. Positioned interiorally of the shell 12 is a stationary vacuum box generally designated by numeral 16 which includes a generally cylindrical pipe-like member 18 although the vacuum box may take other configurations. Longitudinally along the vacuum box 16 is a slot-like opening 20 with each edge thereof, having a longitudinally extending slot or groove 22 receiving a sealing strip 24 therein for forming a closure or seal between the edge of the slotlike opening 20 of the vacuum box 18 and the internal surface of the perforated shell 12. A tube 26 of flexible material is interposed between the inner edge of the sealing strip 24 and the bottom of the slot or groove 22 with the tube 26 being flexible and communicated with a source of fluid pressure, either air or hydraulic, so that the sealing strip 24 can be moved outwardly to a slight degree to retain the outer edge thereof in engagement with the internal surface of the shell to form a seal so that vacuum induced in the interior of the vacuum box 16 will be applied to the internal surface of the shell 12 thus removing water or moisture that penetrates through the perforated shell 12 in a manner well known in the art. The specific details of the supporting structure for the shell 12 and vacuum box 16 are not illustrated nor are the specific details of supplying a vacuum to the vacuum box, pressure to the tube 26 and the association of the shell with the remainder of the paper making machine since these are well known in the art.

Seal strips previously employed in available paper making machines were constructed of a material combining rubber, asbestos and graphite. However, in making the strips, it is necessary to machine them to desired size which introduced the possibility of asbestos fibers being discharged into the ambient atmosphere in the machine shop and likewise during use of the paper making machine, there is a possibility of asbestos fibers being introduced into the ambient atmosphere around the paper making machine. Other materials used in the construction of sealing strips involve the lamination of phenolic resins and canvas and in other machines, a U.H.M.W. polyethylene has been used in association with the table on the Fourdrinier paper making machine. Some of the paper making machines require seal strips of maximum dimensions up to $3\frac{1}{2}''$ square and up to 300" long which eliminates the use of most sheet type materials. The problems relating to asbestos containing materials have been previously discussed and the U.H.M.W. polyethylene wears well but has a high degree of thermal expansion rate and has a failure problem at about 170° . The phenolic/canvas laminate absorbs water and increases in dimensions or swells thus causing it to bind in the supporting slot or groove and this material tends to flake off on the edges due to brittleness after a certain time period thus reducing the life expectancy of the material.

The seal strip 24 of the present invention has a main body portion 27 constructed of an organic material consisting of a polyester and/or vinylester resin matrix with organic fiber reinforcement, for example, aramid fiber reinforcement, the fiber extending to the outer edge 30 of the strip 24 which has been machined accurately to fit and engage the interior of the shell 12 with the ends of the fibers extending to the edge surface 30. The body portion of the seal strip may also include powdered graphite material for reducing friction at the interface between surface 30 and the interior surface of shell 12.

Figure 4:
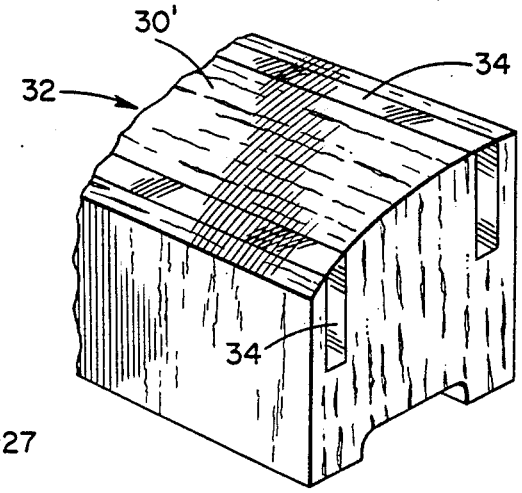
FIG. 4 is a view similar to FIG. 2 showing a silencer strip in accordance with the invention.

Inasmuch as the seal strips 24 are pressurized against the inner surface of the perforated shell, they must not only maintain a seal, they must also be non-abrasive which is accomplished by specific materials from which the seal strips are constructed. Also, the seal strips must have a long life expectancy and long work characteristics since it is quite expensive to shut down the machine, remove the suction rolls, and replace the seal strips. The seal strips themselves are no more than narrow strips machined to fit the mounting slots 22 and extend laterally across the width of the roll with the surface 30 being machined to fit the shell 12 which it engages. One typical strip used is about $\frac{3}{4}''$ wide and $1\frac{1}{2}''$ deep with a length commensurate with the width of the shell of the suction roll. Also, a second seal strip may be used in association with the suction roll which may be $2\frac{3}{4}''$ by $2\frac{1}{2}''$, and machined on the edge to fit the shell 12 with this strip being referred to as a silencer strip, since it reduces the siren noise effect of the perforated shell passing over the vacuum box. A typical silencer strip 32 is shown in FIG. 4. Also, outer surface 30' of the silencer strip may be curved to conform with the interior surface of shell 12, whereas surface 30 of strip 24, due to its decreased width, may be substantially linear.

In accordance with the invention, and for the purpose of further reducing friction and providing lubrication at the interface between surface 30 and the interior surface of shell 12, sealing strip 24 is provided with a narrow lengthwise extending inset strip 34 of PTFE which is exposed at surface 30 so as to rub against the interior of the rotating shell and smear across the interfacing surfaces, thereby producing a lubricant effect. The inset strip may be about $\frac{1}{8}''$ in width and is preferably offset adjacent the leading edge of the seal strip (as considered in the direction of rotation of the shell). The wider silencer strips, such as strip 32 shown in FIG. 4, may have a pair of PTFE inset strips 34 adjacent its opposite edges.

By combining a PTFE insert strip with a wear resistant base material in forming the sealing strip, the resultant structure exhibits the combined advantages of these materials notably the smearing effect of the PTFE providing reduced friction with its attendant advantages, and the hard wearing qualities of the base material.

The body of the sealing strip preferably is constructed completely of organic materials and is non-water absorbent and internally lubricated with the edge grain of the laminate being disposed against the rotating shell 12 to provide better wear and to expose the lubricants more evenly. By providing reduced friction and little or no abrasiveness, the seal strips will have a long life with little wear and also reduced wear will occur on the shell 12 which is usually constructed of bronze, stainless steel or the like thereby enabling the paper making machine to operate continuously without shut down for longer periods of time and also reducing environmental pollution problems caused by machining of the seal strips and by wear of the seal strips when associated with the paper making machine.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a suction roll of a paper making machine having a rotatable perforated cylindrical shell and a vacuum box means disposed stationarily internally of the shell with said vacuum box including an edge structure defining a slot extending throughout the width of the suction roll in operative communication with said vacuum box, and sealing strips extending from said edge structure in the vacuum box and engaging the internal surface of the perforated shell for forming a seal so that vacuum induced in the vacuum box is associated with the internal surface of the perforated shell, each sealing strip comprising a body member of wear resistant material having an outer surface forming an interface with the internal surface of the shell, the improvement wherein each sealing strip further includes a lengthwise inlay strip of PTFE material exposed at said outer surface of the sealing strip for rubbing against the internal surface of the shell and smearing across said outer surface thereby providing reduced friction and improved lubrication at said interface.

2. The combination as defined in claim 1 wherein one of said sealing strips is wider than the other sealing strip, defining a silencer strip, and forms with separate and duplicate inlay strips located a silencer strip adjacent opposite edges of the sealing strip.

3. The combination as defined as in claim 1 wherein the body member of each sealing strip is constructed of a resin matrix with organic fiber reinforcement.

4. The combination as defined in claim 3 including friction-reducing graphite in the matrix.

* * * * *